United States Patent [19]

Aoki

[11] 4,338,706

[45] Jul. 13, 1982

[54] ADJUSTABLE FASTENER

[75] Inventor: Tsunetaka Aoki, Kamiichi, Japan

[73] Assignee: Yoshida Kogyo K.K., Tokyo, Japan

[21] Appl. No.: 129,072

[22] Filed: Mar. 10, 1980

[30] Foreign Application Priority Data

Mar. 19, 1979 [JP] Japan ..... 54-35385[U]

[51] Int. Cl.[3] ..... A44B 21/00

[52] U.S. Cl. ..... 24/70 R; 24/206 R

[58] Field of Search ..... 24/70 SK, 70 ST, 70 R, 24/206 R, 170

[56] References Cited

U.S. PATENT DOCUMENTS

| | | | |
|---|---|---|---|
| 1,838,463 | 12/1931 | Statham | 24/206 R |
| 1,997,836 | 4/1935 | Steinberg | 24/206 R X |
| 2,208,257 | 7/1940 | Greenberg | 24/206 R |
| 2,502,901 | 4/1950 | Taberlet | 24/206 R |
| 2,609,581 | 9/1952 | Statham | 24/206 R X |
| 2,995,792 | 8/1961 | Morton, Jr. | 24/206 R |
| 4,133,082 | 1/1979 | Kanzaka | 24/206 R |

FOREIGN PATENT DOCUMENTS 53-141103 11/1978 Japan .

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

An adjustable fastener for interconnecting a first part and a second part, comprising: an elongate rack adapted to be secured to the first part and having a row of teeth; and a slider adapted to be fastened to the second part and movable on and along the rack for locking engagement therewith at a selected position. The slider comprises a housing having a longitudinal channel for passage therethrough of the rack, and a groove extending transversely of and opening toward the channel. A locking member is slidably held within the groove for locking engagement with one of the teeth. Elongate resilient means extends in an along the channel for normally retaining in its free state the locking member in locking engagement with said one of the teeth, the locking member being movable along the groove out of locking engagement with said one of the teeth against the force of the resilient means.

9 Claims, 13 Drawing Figures

ADJUSTABLE FASTENER

BACKGROUND OF THE INVENTION

1. Field of the Invention

The present invention relates to an adjustable fastener for interconnecting a first part and a second part.

2. Prior Art

Japanese Utility Model Laid-open Publication No. 53-141103, later also published as U.S. Pat. No. 4,133,082, discloses an adjustable fastener which comprises an elongate rack having a pair of rows of teeth, and a slider movable on and along the rack for locking engagement therewith at a selected position thereon. The slider includes a locking member slidably mounted on a slider body and normally urged by a spring into locking engagement with one of teeth of the rack on and along which the slider is movable. The slider body has a guide slot in its outer surface which receives a ridge on an arm of the locking member for transverse guidance of the latter with respect to the slider body. Fibrous dust or other foreign matter tends to enter and be deposited in such exposed slot, with the result that the movement of the locking member may become sluggish or even jammed. Furthermore, with a substantial part of the locking member being over the slider body, the slider is susceptible to accidental unlocking due to forces imposed on such part of the locking member, is unsightly in appearance, and has a relatively high profile or thickness. Another disadvantage of the prior slider is that the spring is loaded or compressed at all times even when the locking member is in its locking position. Accordingly, the spring is subjected to fatigue and liable to lose its resiliency in prolonged use.

SUMMARY OF THE INVENTION

According to the present invention, a locking member is slidably held within a groove extending transversely of and opening toward a longitudinal channel in a slider housing for passage therethrough of an elongate rack of an adjustable fastener. The locking member lockingly engages one of a row of teeth of the elongate rack at a selected position thereon. An elongate resilient means in its free state extends in and along the channel for normally retaining the locking member in locking engagement with said one of the teeth. The locking member is movable along the groove out of locking engagement with said one of the teeth against the force of the resilient means. The slider housing comprises a shell having the groove, a guide frame mounted in the shell and having the channel and a retainer mounted on the shell for holding the guide frame in the shell. The resilient means comprises a linear spring wire disposed in a longitudinal cavity in the shell, the cavity being in the shape of a segment having a flat wall and confronting concave wall. The linear spring wire is normally held against the flat wall when the locking member is held in locking engagement with said one of the teeth, and is resiliently flexible toward the concave wall when the locking member is moved out of engagement with said one of the teeth.

An object of the present invention is to provide an adjustable fastener capable of reliable locking operation over a long period of time.

It is another object of the present invention to provide an adjustable fastener having a slider of a relatively low profile.

It is still another object of the present invention to provide a durable slider for an adjustable fastener.

Still another object of the present invention is to provide such a slider including resilient means having a long service life for retaining a locking member in its locking position.

Many other advantages, features and additional objects of the present invention will become manifest to those versed in the art upon making reference to the detailed description and the accompanying drawings in which preferred structural embodiments incorporating the principles of the present invention are shown by way of example.

DETAILED DESCRIPTION

The principles of the present invention are particularly useful when embodied in an adjustable fastener such as shown in FIGS. 2–5, generally indicated by the numeral 20.

Figure 6:
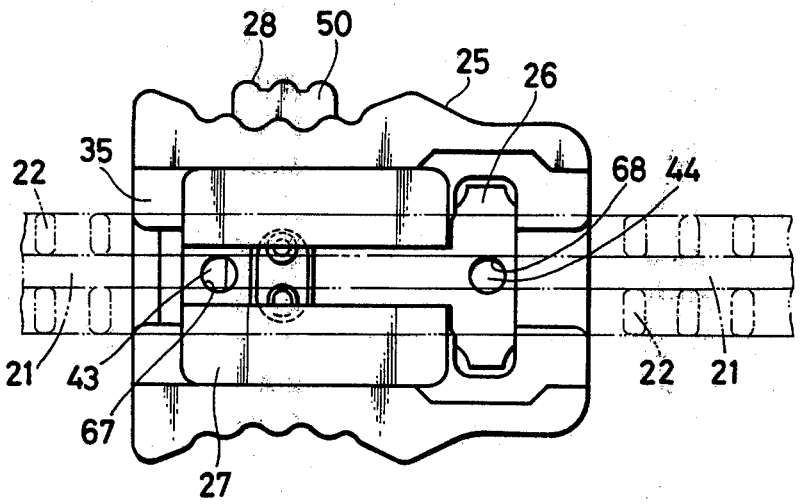
FIG. 6 is a bottom view of the slider.

The adjustable fastener 20 comprises an elongate rack 21 having a pair of rows of teeth 22 (best shown in FIGS. 3 and 6) and a slider 23 movable on and along the rack 21 for locking engagement with the rack 21 at a selected position thereon.

Figure 1:
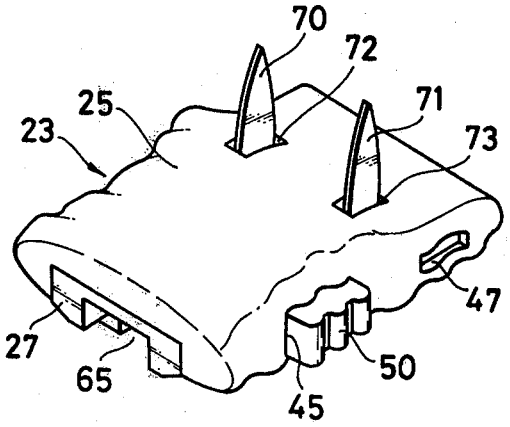
FIG. 1 is a perspective view of a slider constructed in accordance with the invention.
Figure 2:
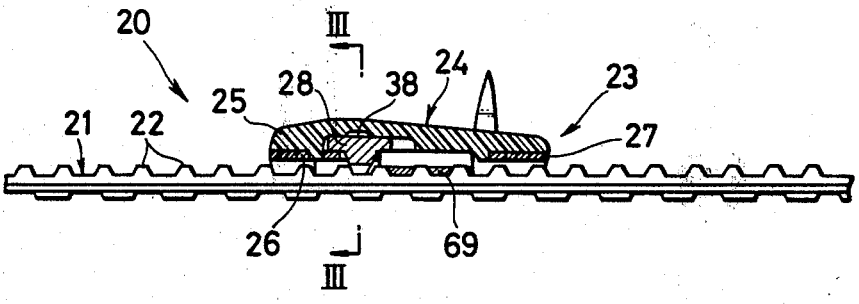
FIG. 2 is a longitudinal cross-sectional view of the slider of FIG. 1 mounted on a rack.
Figure 3:
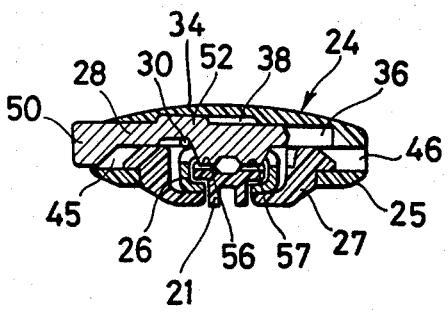
FIG. 3 is a transverse cross-sectional view of the slider taken along line III—III of FIG. 2.
Figure 4:
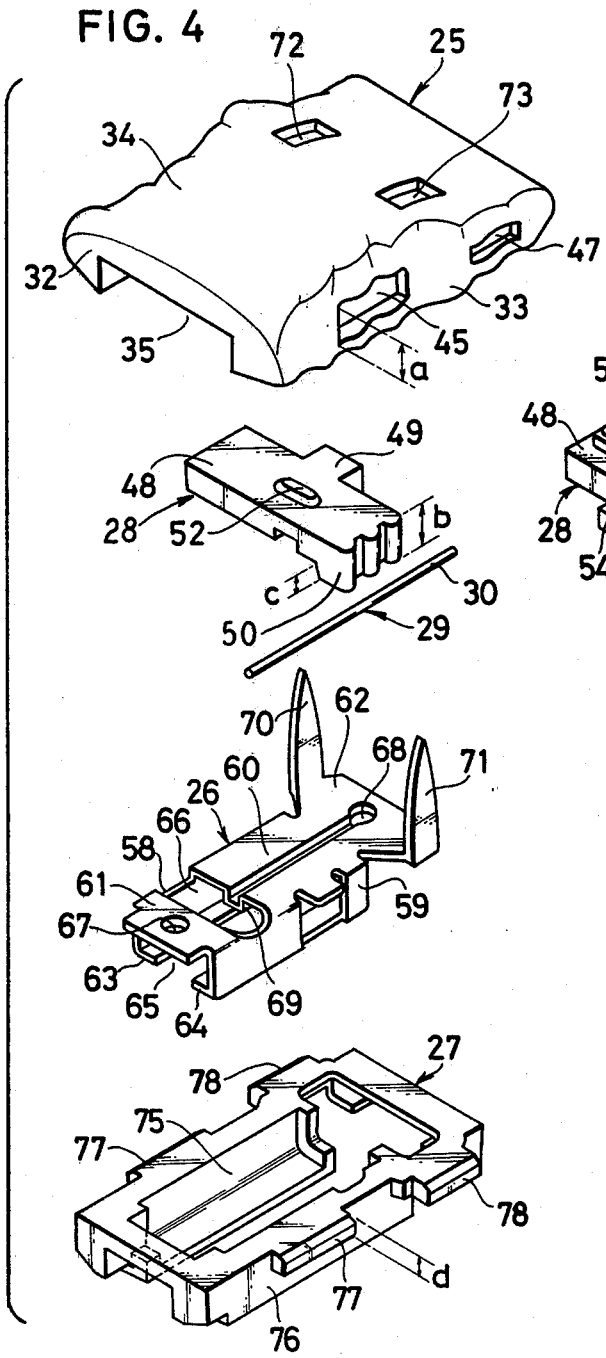
FIG. 4 is an exploded perspective view of the slider shown in FIG. 1.
Figure 5:
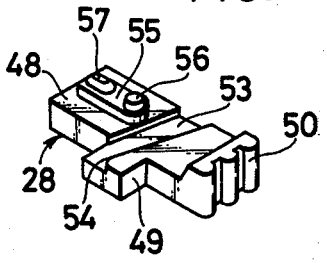
FIG. 5 is a perspective view of the locking member as it is held upside down.

As best illustrated in FIG. 4, the slider 23 comprises a housing 24 (FIGS. 2 and 3) including a shell 25, a guide frame 26, and a retainer 27. The slider 23 also has a locking member 28 mounted in the shell 25 for locking engagement with one pair of the teeth 22 of the rack 21, and elongate resilient means 29 such as a linear spring wire 30 disposed in the shell 25 and normally retaining in its free state the locking member 28 in its locking position.

Figure 7:
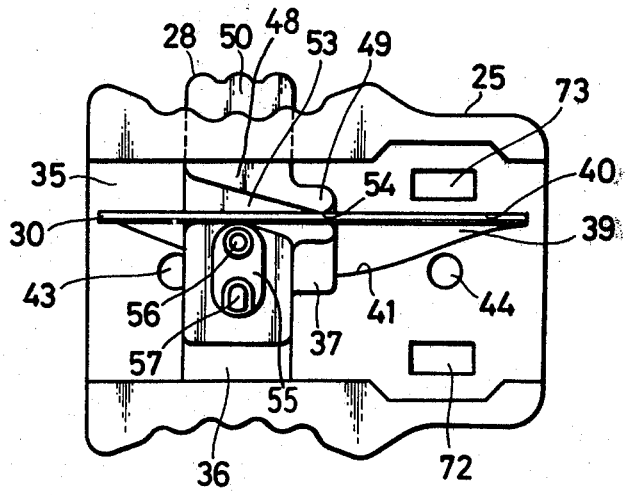
FIG. 7 is a view similar to FIG. 6, with parts removed to show the interior of the slider.

The shell 25 is composed of a pair of sidewalls 32,33 connected at one edge by a top plate 34, there being a recess 35 defined jointly by the sidewalls 32,33 and the top plate 34 and extending longitudinally of the shell 25 for receiving therein the guide frame 26 and the retainer 27. The top plate 34 has in its underside a groove 36 extending transversely to the recess 35, the groove 36 including a longitudinal nose portion 37 (FIG. 7). There is a transverse guideway 38 recessed in the top plate 34 and opening toward the groove 36 for guiding and limiting the sliding movement of the locking member 28. Formed also in the underside of the top plate 34 is a longitudinal cavity 39 (FIG. 7) extending across the transverse groove 36 and its nose portion 37. The cavity 39 is in the shape of a segment defined by a flat wall 40 and a confronting concave wall 41. The linear spring wire 30 is normally held against the flat wall 40 when the locking member 28 is held in locking engagement with one pair of teeth 22 of the rack 21 and is resiliently flexible toward the concave wall 41 when the locking member 28 is moved out of engagement with the one pair of the teeth 22. A pair of longitudinally aligned dowels 43,44 (FIGS. 6 and 7) projects from the top plate 34 into the recess 35 for locating the guide frame 26 with respect to the shell 25. The sidewalls 32,33 have laterally aligned apertures 45,46 (FIG. 3), respectively. One of the apertures 45 is formed as an extension of the groove 36 and has a height a. The sidewalls 32,33 also have another pair of laterally aligned apertures 47 (only one shown in FIG. 4), respectively, horizontally aligned with and longitudinally spaced from the apertures 45,46.

The locking member 28 has a body portion 48 with a lateral arm 49 slidable in and along the groove nose portion 37 and a thickened head portion 50 having a thickness b greater than that of the body portion 48 by the distance c. The thickness b of the head portion 50 is substantially the same as the height a of the aperture 45 so as to allow the head portion 50 to be snugly fitted in the aperture 45. The body portion 48 has on its top surface a projection 52 which is slidably disposed in and along the guideway 38 in the top plate 34. Formed in the bottom surface of the body portion 48 is a transverse slot 53 slanting away from the head portion 50 toward the lateral arm 49 so that the distal end 54 of the lateral arm 49 engages with a substantially central portion of the linear spring wire 30 disposed in the segmental cavity 39 and extending through the slot 53. Disposed adjacent to the slot 53 and remote from the head portion 50 is an elongate base 55 having a pair of spaced locking projections 56,57 engageable with one laterally aligned pair of teeth of the rack 21.

The guide frame 26 is made of sheet metal and of a substantially C-shaped cross section. The guide frame 26 is comprised of a pair of sidewalls 58,59 connected at one edge by a top plate 60 with extensions 61,62 projecting beyond ends of the sidewalls 58,59. The sidewalls 58,59 have flanges 63,64 remote from the top plate 60 and extending toward each other, defining therebetween a longitudinal channel 65 in which the elongate rack 21 is received. The top plate 60 has a transverse recess 66 receiving therein the locking projections 56,57 of the locking member 28. The top plate 60 also has in its end extensions 61,62 a pair of longitudinally aligned holes 67,68 receiving therein the dowels 43,44 on the shell top plate 34. A longitudinal ridge 69 projects from the guide frame's top plate 60 into the channel 65 and extends between the recess 66 and the hole 68 in the extension 62, the ridge 69 lying in a space between the rows of teeth 22. The extension 62 has a pair of laterally spaced, upstanding pointed legs 70,71 extending respectively through a pair of apertures 72,73 in the shell top plate 34.

The retainer 27 has a rectangular frame including a pair of L-shaped seats 75,76, and has a width substantially equal to the width of the recess 35 in the shell 25. The seats 75,76 jointly support the guide frame 26 therein. The retainer 27 has two pair of lateral wings 77,78, each of which has a height d substantially equally to the dimension c and fitted in the apertures 45,46,47. The upper edges of the wings 77,78 are chamferred or rounded so as to allow the wings 77,78 to be snapped into the apertures 45,46,47 when the retainer 27 is assembled onto the shell 25.

The slider 23 is assembled by first placing the locking member 28 into the groove 36 in the shell 25 with the head portion 50 of the locking member 28 projecting out of the aperture 45. The linear spring wire 30 is then disposed in the segmental cavity 39 against the flat wall 40 thereof through the slanted slot 53 in the locking member 28. At this time, the distal end 54 of the lateral arm 49 contacts the linear spring wire 30 at its substantially central portion as shown in FIG. 7. The guide frame 26 is then placed on the seats 75,76 of the retainer 27. The retainer 27 with the guide frame 26 supported therein is combined with the shell 25 by snappingly fitting the wings 77,78 in the apertures 45,46,47. The guide frame 26 is fixedly held with respect to the shell 25 through interfitting engagement of the dowels 43,44 in the holes 67,68. The upright pointed legs 70,71 of the guide frame 26 protrude through the apertures 72,73, respectively, in the top plate 34 of the shell 25.

Figure 8:
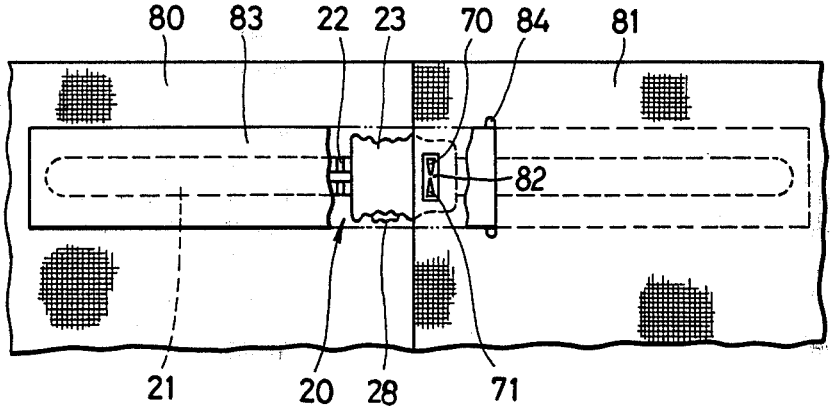
FIG. 8 is a plan view showing an adjustable fastener employing the slider of the invention, the adjustable fastener being mounted on pieces of cloth.
Figure 9:
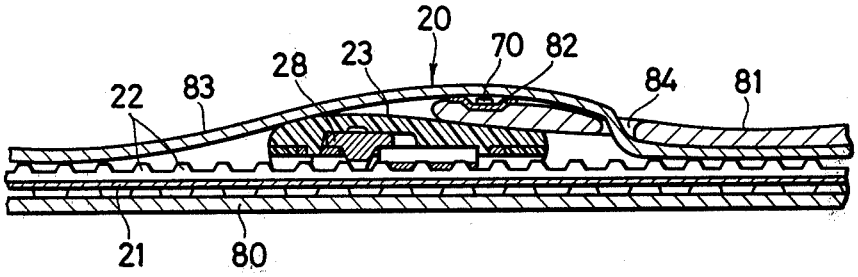
FIG. 9 is a longitudinal cross-sectional view of the adjustable fastener of FIG. 8.
Figure 10:
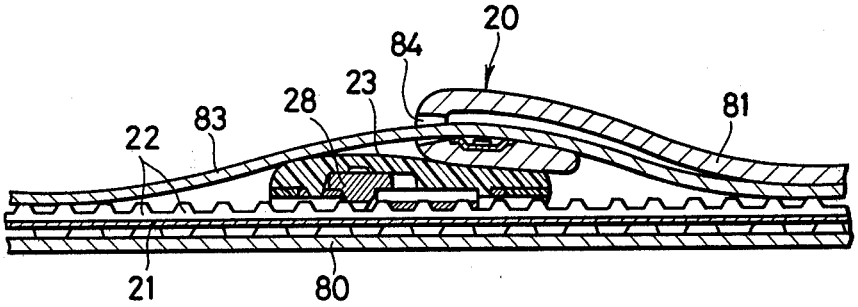
FIG. 10 is a view similar to FIG. 9, showing another mode of application in which the adjustable fastener is used.

The adjustable fastener 20 is used as illustrated in FIGS. 8 through 10. The rack 21 is secured to a first cloth part 80 of a garment, bag, cap or the like. The slider 23 is slidably mounted on and along the rack 21 and fastened to a second cloth part 81 by the pointed legs 70,71 piercing the second part and a washer 82 placed thereon and clinched thereto. A protection cover strip 83 is mounted on the first part 80 and extends over the rack 21, the strip passing over the slider 23, a portion of the second cloth part 81, through a transverse slot 84 in the second cloth part 81, and under a further portion thereof. In FIG. 10, which shows another mode of application of the adjustable fastener 20, the second cloth part 81 is folded over and fastened to the slider 23 with its transverse slot 84 opening toward an advancing direction of the slider so as to reduce friction between the protective cover strip 83 and the second part 81 of the cloth.

The adjustable fastener 20 functions as follows:

The locking member 28 is pushed by the user's fingers so as to shift from a first position as shown in FIG. 7 to a second position where the locking projections 56,57 of the locking member 28 are held out with one pairs of the teeth 22 of the rack 21. At this time, the linear spring wire 30 is resiliently flexed toward the concave wall 41 of the cavity 39. The slider 23 is then moved along the rack 21 toward a desired position on the rack 21. Upon arrival to the desired position, the user releases the locking member 28 so that the locking projections 56,57 are automatically returned into the first position under the resilient force from the linear spring wire 30.

Figure 11:
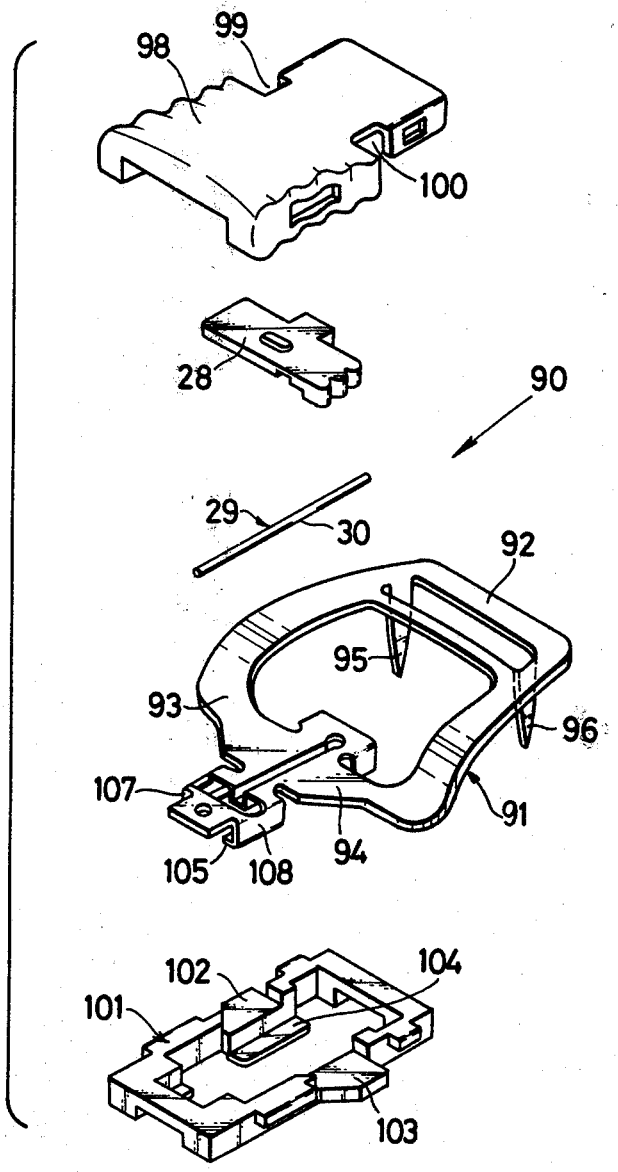
FIG. 11 is an exploded perspective view of a modified slider according to the present invention.

A slider 90 according to a second embodiment of the present invention is illustrated in FIG. 11. The second embodiment is described only with respect to the differences between it and the first embodiment shown in FIG. 4. A guide frame 91 has a buckle 92 having integrally formed upwardly-bent bifurcated wing portions 93,94. The buckle 92 includes a pair of laterally aligned fastening prongs 95,96 projecting downwardly from the frame proper. A housing or shell 98 has a pair of recesses 99,100 through which the wing portions 93,94 extend, respectively. A retainer 101 has a pair of wings 102,103 on its side flanges 104 (only one shown), respectively for supporting thereon the wing portions 93,94 of the guide frame 91. When the guide frame 91 is assembled with the retainer 101, the side flanges 104 lie flush with a pair of flanges 105 of a pair of sidewalls 107,108 of guide frame 91.

Figure 12:
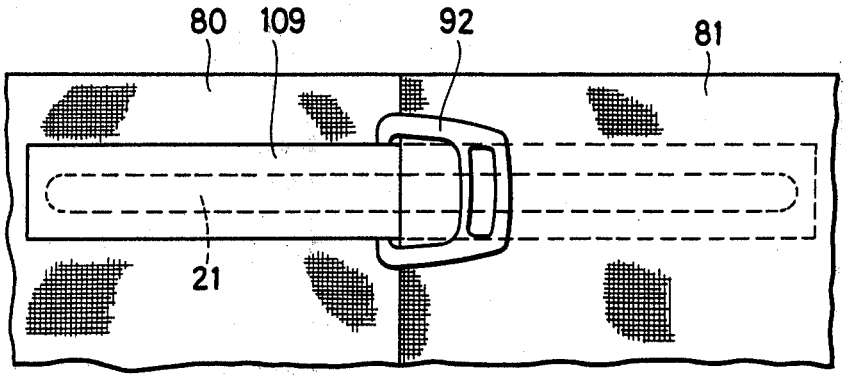
FIG. 12 is a plan view showing an adjustable fastener employing the slider of FIG. 11, the adjustable fastener being mounted on pieces of cloth.
Figure 13:
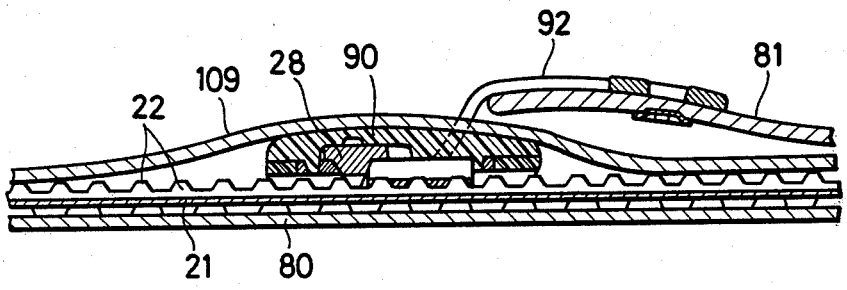
FIG. 13 is an enlarged longitudinal cross-sectional view of the adjustable fastener of FIG. 12.

As shown in FIGS. 12 and 13, a protective cover strip 109 is held out of frictional contact with the second part of the cloth 81 to which the slider 90 is fastened, so that the slider 90 can move more smoothly than the first embodiment.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An adjustable fastener for interconnecting a first part and a second part, comprising:

(a) an elongated rack adapted to be secured to the first part and having a row of teeth; and (b) a slider adapted to be fastened to the second part and movable on and along said rack for locking engagement therewith at a selected position, said slider comprising:

(1) a housing having a longitudinal channel for passage therethrough of said rack, said housing comprising a shell having a groove extending transversely of and opening toward said channel, a guide frame mounted in said shell and having said channel, and a retainer mounted on said shell holding said guide frame in said shell;

(2) a locking member slidably held within said groove for locking engagement with one of said teeth; and (3) elongate resilient means extending in and along said channel for normally retaining in its free state said locking member in locking engagement with said one of said teeth, said locking member being movable along said groove out of locking engagement with said one of said teeth against the force of said resilient means.

2. An adjustable fastener according to claim 1, said locking member having at least one locking projection, said guide frame having a transverse recess through which said locking projection extends into said channel.

3. An adjustable fastener according to claim 1, said guide frame comprising at least one pointed leg extending through said shell for fastening the second part to said shell.

4. An adjustable fastener according to claim 1, said shell having a longitudinal cavity, and said elongate resilient means being disposed in said longitudinal cavity.

5. An adjustable fastener according to claim 4, said resilient means comprising a linear spring wire, and said cavity being in the shape of a segment having a flat wall and a confronting concave wall, said linear spring wire being normally held against said flat wall when said locking member is held in locking engagement with said one of said teeth, and being resiliently flexible toward said concave wall when said locking member is moved out of engagement with said one of said teeth.

6. An adjustable fastener according to claim 5, said locking member engaging a substantially central portion of said linear spring wire.

7. An adjustable fastener according to claim 1, including a buckle formed integrally with said guide frame and extending outwardly of said shell.

8. An adjustable fastener according to claim 7, said buckle having at least one pointed leg for fastening connection with the second part.

9. An adjustable fastener according to claim 1, said locking member having a push head, said shell having an opening continuous to said groove and through which said push head projects outwardly of said shell.

* * * * *